United States Patent [19]
Brown
[11] 4,194,653
[45] Mar. 25, 1980

[54] FLUID DISPENSING APPARATUS

[76] Inventor: Joe L. Brown, P.O. Box 624, Mesilla, N. Mex. 88046

[21] Appl. No.: 867,538

[22] Filed: Jan. 6, 1978

Related U.S. Application Data

[63] Continuation-in-part of Ser. No. 752,202, Dec. 20, 1976, abandoned.

[51] Int. Cl.² ..... B65D 83/14
[52] U.S. Cl. ..... 222/402.25
[58] Field of Search ..... 222/402.25

[56] References Cited

U.S. PATENT DOCUMENTS 2,682,977 7/1954 Spiess et al. ..... 222/402.25
2,830,745 4/1958 Aicart ..... 222/402.25 X

FOREIGN PATENT DOCUMENTS 976784 11/1950 France ..... 222/402.25

*Primary Examiner*—Allen N. Knowles
*Attorney, Agent, or Firm*—Fleit & Jacobson

[57] ABSTRACT

An apparatus for dispensing carbonated fluids or beverages which employs the vapor pressure of the beverage, i.e., the pressure of carbonation, as the sole propelling or dispensing force, is disclosed. The apparatus comprises a valve mechanism that includes a main valve body and an adapter for detachably coupling the valve mechanism to the fluid container or bottle. An elongated siphoning tube projects into the fluid container and in self-sealing engagement with the adapter means. The valve mechanism further comprises a valve stem movably mounted within a central cavity or channel formed in the main valve body, a fluid discharge spout in operable communication with the cavity or channel and a spring which serves to maintain the valve in a normal closed position. The fluid is discharged from the container by causing the valve stem to be moved into a downward and open position. The apparatus of the invention comprises a minimum of parts, may be easily manufactured and avoids the disadvantages of known dispensing apparatus. In accordance with a particularly advantageous embodiment of the invention, the adapter, used to secure the valve mechanism to the container, is designed such that it is readily adaptable for use with fluid containers or bottles of varying designs and shapes.

8 Claims, 6 Drawing Figures

FLUID DISPENSING APPARATUS

RELATIONSHIP TO CO-PENDING APPLICATIONS

The present application is a continuation-in-part of U.S. patent application Ser. No. 752,202, filed Dec. 20, 1976, now abandoned.

BACKGROUND OF THE INVENTION

1. Field of the Invention

The present invention relates to a fluid dispensing apparatus and, more particularly, to a new and improved method and apparatus for dispensing fluids wherein the inherent vapor pressure of the fluid itself is used as the sole propelling force for dispensing the fluid.

2. The Prior Art

In recent years, a relatively large number of fluid dispensing apparatus, of many and varying designs, have been proposed for dispensing fluids or beverages. While such apparatus have achieved commercial acceptance, at least to some limited extent, they suffer from a number of known disadvantages. One such deficiency lies in the fact that known fluid dispensers are structurally complex and are thus difficult and expensive to manufacture. A further and very significant disadvantage of known fluid dispensers lies in the fact that to dispense the fluid, an individual and separate propelling force must be employed. In general, such means include a piston-type fluid actuating mechanism and/or a pressurized gas (e.g., carbon dioxide) cartridge. Specific examples of apparatus involving the use of piston-type fluid actuating mechanism for dispensing the fluid, are disclosed in U.S. Pat. Nos. 2,547,109; 3,458,090 and 2,837,247. Further examples of known prior art devices, and including those which employ the aforenoted carbon dioxide cartridges, are disclosed in U.S. Pat. Nos. 565,922; 1,648,575; 2,049,851; 2,189,643; 2,199,655; 2,915,251; 3,154,224 and 3,221,953. Notwithstanding the fact that a large number of such designs are known, it has been found that the piston-type actuating mechanism, as well as the carbon dioxide cartridges, are very often difficult to operate and by their inherent nature involve additional expense, both in the original purchase price of the device as well as in the overall expense of their operation and maintenance. The present invention provides a dispensing apparatus and technique that overcomes the disadvantages of such prior known apparatus.

SUMMARY OF THE INVENTION

In summary, the present invention relates to a unique dispenser for dispensing carbonated fluids and beverages. In its broadest aspect, the present invention embodies the concept of dispensing the fluid in a manner such that the vapor pressure of the beverage or fluid itself is used as the sole propelling or dispensing force. The apparatus of the invention, and again broadly speaking for the moment, comprises a dispensing valve mechanism that includes a main valve body and an adapter for detachably coupling the valve mechanism to the container. The valve mechanism further comprises a valve stem movably mounted within a central channel or core formed in the main valve body and a fluid discharge spout in operable communication with said channel or core. An elongated siphoning tube projects into the fluid container and in self-sealing engagement with the adapter means. Resilient means, i.e., a spring, engage a retaining cap secured to one end of the valve stem and maintains the valve stem in a normally closed position. Upon the application of a force to the cap, the valve stem is caused to be moved downwardly and into an open position. The fluid in the container is forced by the vapor pressure of the fluid itself, i.e., the pressure of carbonation of the liquid being dispensed, into the tube and then into the channel in communication with the discharging spout.

While the apparatus of the invention may be employed for dispensing a large number of fluids, it has particular utility for use in dispensing carbonated beverages such as soft drinks, beer, various carbonated mixes, etc., that are typically bottled in relatively large, (i.e., 24 to 32 fluid ounces) resealable bottles or containers. As previously noted, the sole operating power for dispensing the fluid in accordance with the instant invention comprises the inherent vapor pressure of the fluids being dispensed. The apparatus of the invention is very simple to operate, i.e., the cap of the valve stem is simply pressed with the thumb or finger which causes the valve face, formed on the lower end of the valve stem, to separate from the valve seat. This separation allows the fluid from the container to be forced into the elongated siphoning tube and then on out the discharging spout.

It is accordingly a general object of the present invention to provide a dispensing device wherein the inherent pressure of carbonation of the fluid itself is used as the sole propelling force.

Yet another object of the invention is to provide a dispensing device that is simple in construction and relatively inexpensive to manufacture.

A further object of the invention is to provide a dispensing device which comprises a minimum of parts and which may be assembled and/or replaced very simply and inexpensively.

Yet still another object of the invention is to provide a dispensing apparatus for dispensing fluid and beverages which, because of its low cost and ease in use, is ideally suitable for use in the home, in restaurants, at picnics, public gatherings and the like.

BRIEF DESCRIPTION OF THE DRAWINGS

The manner in which the foregoing and other objects are achieved in accordance with the present invention will be better understood in view of the following detailed description and accompanying drawings, and wherein.

DETAILED DESCRIPTION OF PREFERRED EMBODIMENT(S)

Figure 1:
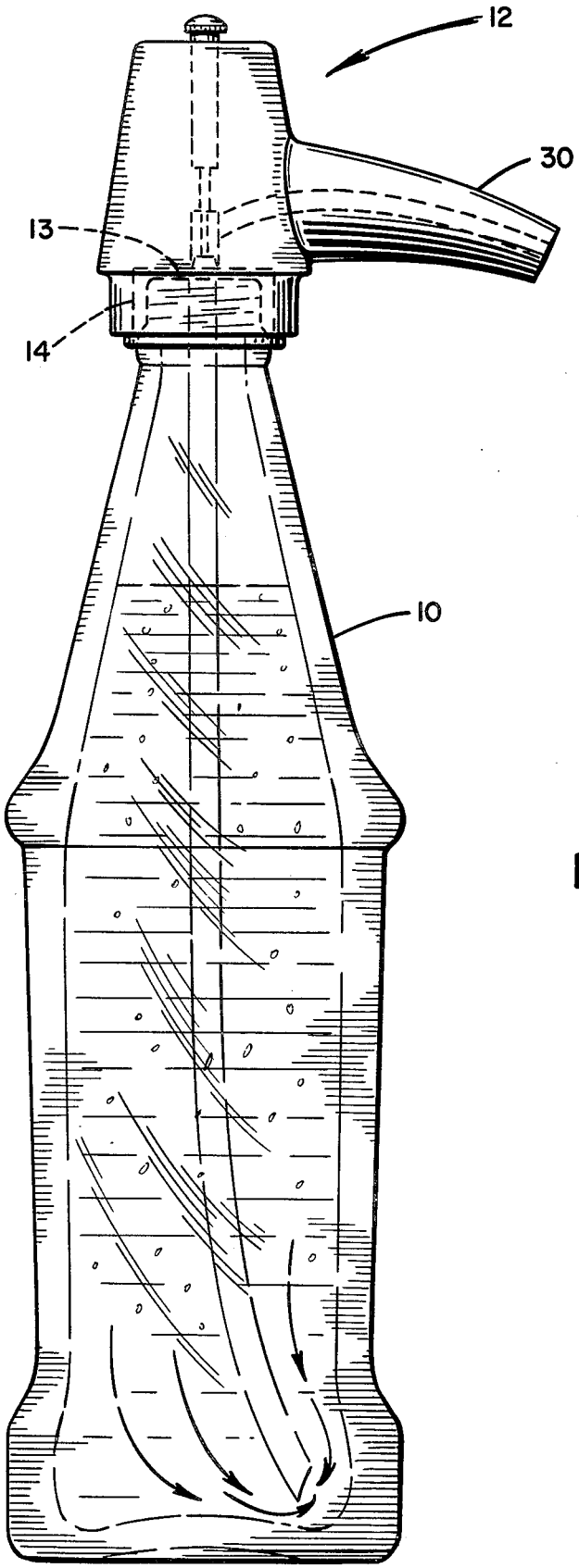
FIG. 1 is a side elevational view of a beverage container in combination with the valve mechanism of the present invention.
Figure 2:
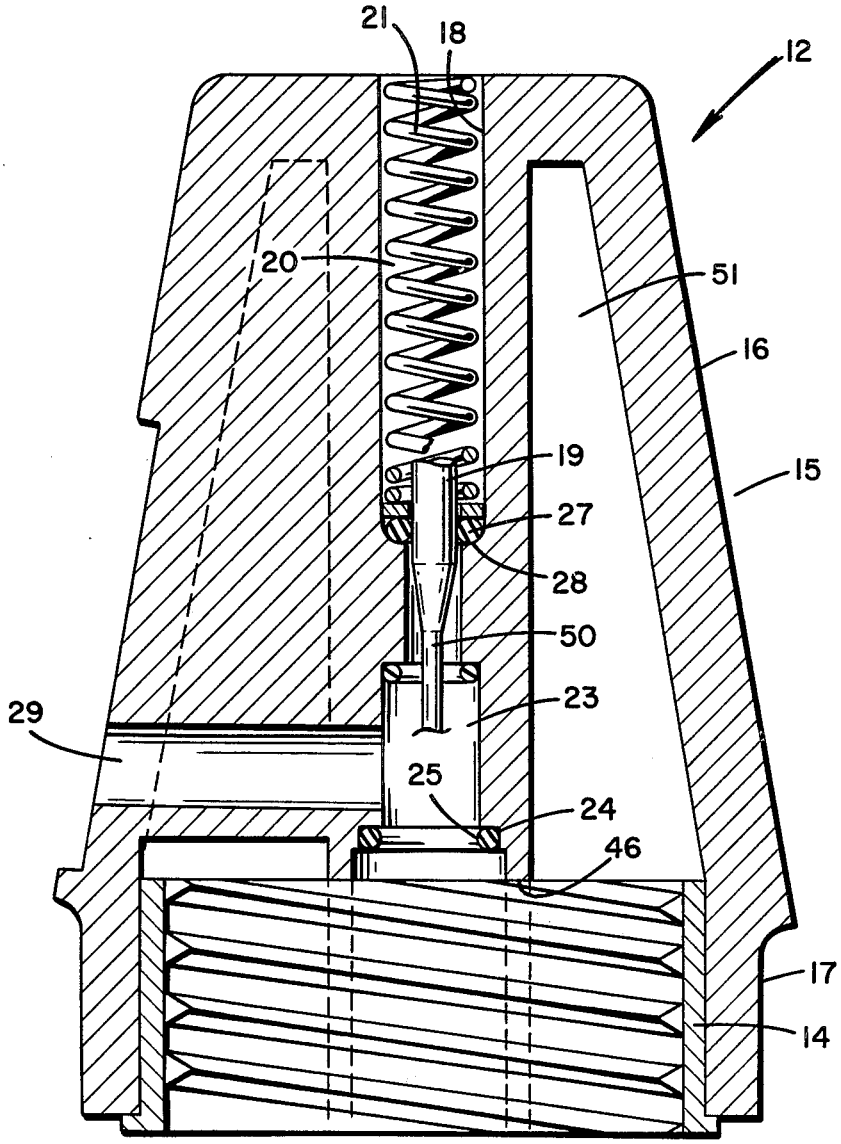
FIG. 2 is a sectional view, in side elevation, illustrating the details of the main valve body of the valve mechanism of the present invention.

With reference now to the drawings in detail and first to FIGS. 1 and 2, there is shown a particularly advantageous arrangement of apparatus which comprises a fluid container 10 and a valve mechanism 12, the latter being secured to the mouth or discharge opening 13 of the container 10 by way of an internally threaded adapter 14. In the embodiment illustrated in FIG. 1, the fluid container 10 comprises a conventional soft drink bottle which may be made of glass or other known materials. The materials of construction of the fluid container do not, of course, comprise any part of the present invention. The valve mechanism itself may also be formed of known materials, i.e., plastics, lightweight metals, etc., but is preferrably formed of a high impact plastic material, such as polyethylene, polystyrene and the like.

Figure 3:
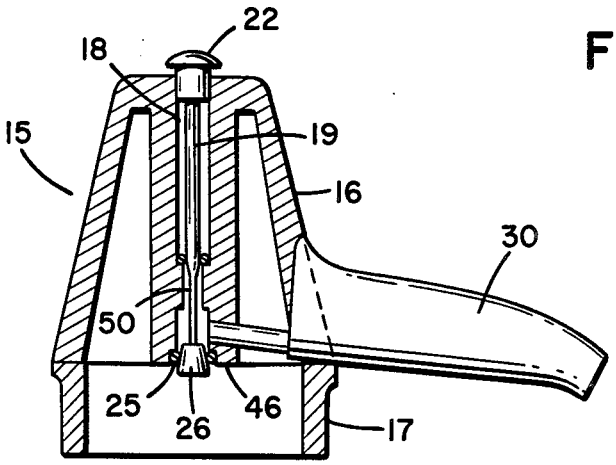
FIG. 3 is a sectional view, similar to FIG. 2, except on a smaller scale and further showing the valve mechanism of the present invention.

As best shown in FIGS. 2 and 3, the valve mechanism 12 comprises a main valve body 15 having a conically shaped sidewall 16 which terminates in a lower annular flange 17. The main valve body 15, again as best shown in FIGS. 2 and 3, includes a central or internal valve-stem passageway or cavity 18, which is adapted to receive a valve stem, indicated generally at 19. The valve-stem cavity 18 includes an upper enlarged portion 20 for receiving a resilient member or spring 21 which engages a cap 22 secured to the upper portion of the valve stem. The internal cavity or passageway 18 further includes an enlarged lower portion 23 and a lowermost annual groove or recess 24, the latter serving, in combination with an O-ring 25, to provide a surface (or valve seat) for the sealing engagement with the face of a valve 26 secured to the lower portion of the valve stem 19 as shown in FIG. 3. Because the spring constantly forces the cap 22 upwardly, while at the same time maintaining the valve stem O-ring 27 into forced contact with the valve-stem 19 and the inner walls of the chamber 20, the valve 26 is maintained in a normally closed position. In this regard, it has been found in the practice of the instant invention that the lowermost wall portion of the cavity 20 must be curved in the manner as illustrated in FIGS. 2 and 3 so as to maintain an effective leak-proof seal. If the curvature is provided as shown in the drawings, then the spring 21 forces the O-ring 27 against the curved wall portions 28 and against the surface of the valve-stem 19. As shown in FIG. 2, a small protective washer is preferably positioned between the lowermost portion of the spring 21 and the O-ring 27.

In operation, the fluid is discharged from the container 10 by depressing the cap 22 with the thumb or finger of the user. The depression of this cap causes the valve stem to be moved in the downwardly direction, the latter serving to compress the spring thus allowing the face of the valve 26 to separate from the valve seat formed by the annular recess 24 and O-ring 25 as best shown in FIGS. 2 and 3. This separation allows the fluid within the container to be forced by the pressure of carbonation through the siphon tube 11 and into the valve chamber 23 and finally through the exhaust passageway 29 and out the discharge spout 30. As shown, the exhaust passageway 29 connects the lower annular chamber or enlarged portion 23 with the passageway 31 of the discharge nozzle or spout 30.

Figure 4:
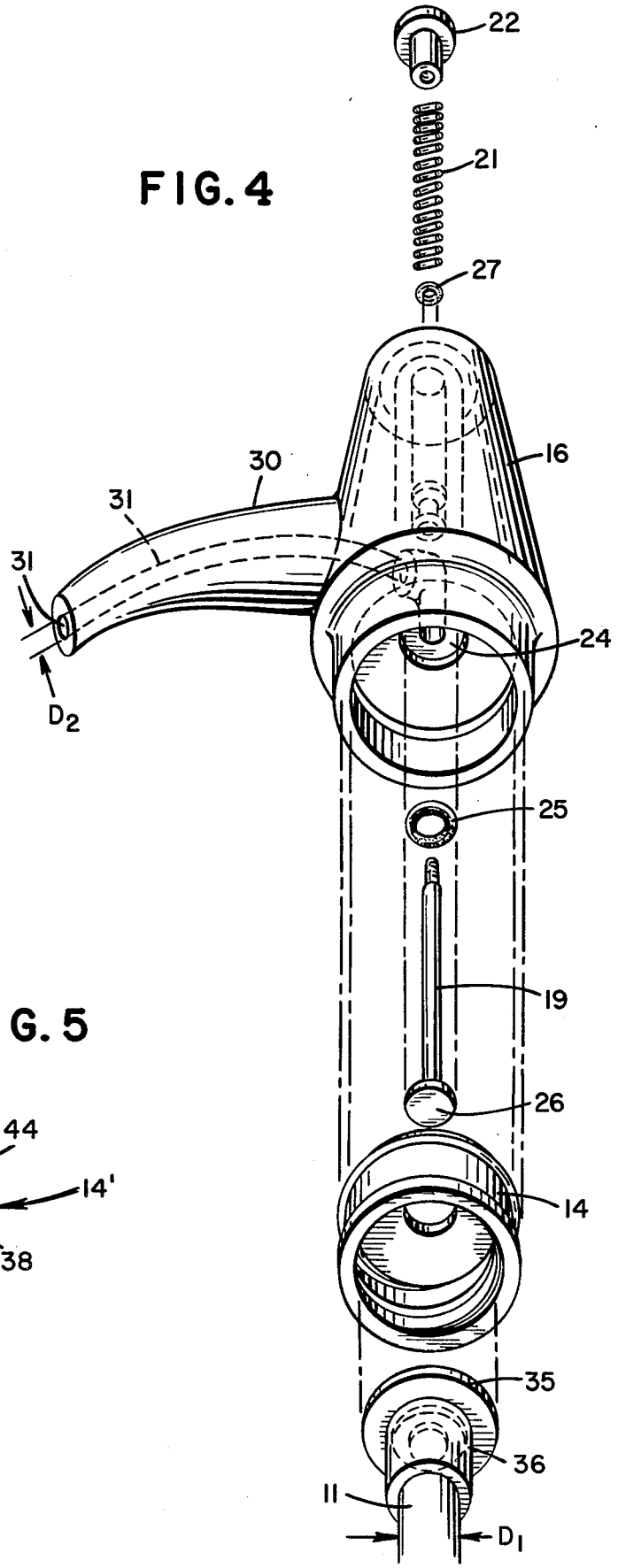
FIG. 4 is a perspective expanded view illustrating the component parts of the apparatus of the invention.

It may be noted at this point that the basic discovery upon which the instant invention is based embodies the concept of the use of the inherent pressure of carbonation as the sole power for dispensing carbonated fluids or beverages. In the development of the present invention, it was first discovered that the pressure of carbonation was, by itself, sufficient and effective to dispense the carbonated beverage. However, another feature of the present invention resides in the further discovery that to obtain a constant liquid flow from the exhaust nozzle or spout 30 (as opposed to, e.g., a pulsating foamed gas-liquid mass) the internal diameter of the exhaust passageway 31 formed in the nozzle 30 must be less than the internal diameter of the siphoning tube itself. With reference to FIG. 4, the ratio of the internal diameter $D_1$ of the siphoning tube must be at least 1.2 times that of the internal diameter $D_2$ of the internal passageway 31, with a preferred and particularly advantageous ratio being in the range of from between about 1.2:1.0 to 2.0:1.0.

Turning now to further and more specific details of the invention, and with reference first to FIGS. 2 and 4, in accordance with one embodiment of the invention, an internally threaded adapter 14 is positioned within, and formed integral with, the inner surfaces of the annular flange portion 17 of the main valve body 15. The internal threadings of the adapter 14 are designed such that they conform, and/or mate with, standard external threadings of bottles or containers used in the carbonated beverage industry. In the practice of this embodiment, the re-seal type cap of the fluid container or bottle 10 is simply removed with the siphon tube 11 being inserted into the bottle. The valve mechanism 12 is then simply slipped over an annular sealing ring 35 and cylindrical stiffening means 36 secured to the upper portion of the siphoning tube 11 with the nozzle then being attached to the discharge opening 13 of the container 10 by tightening or turning the valve mechanism until a tight seal is formed. In this embodiment, the upper surface of the discharge opening 13 of the bottle presses against the lower surface of the annular sealing ring 35 and maintains the latter in sealing engagement with the adapter 14. The beverage or fluid is then discharged from the bottle by simply pressing the cap 22 in a downward direction and in the manner as set forth in detail hereinabove.

Figure 6:
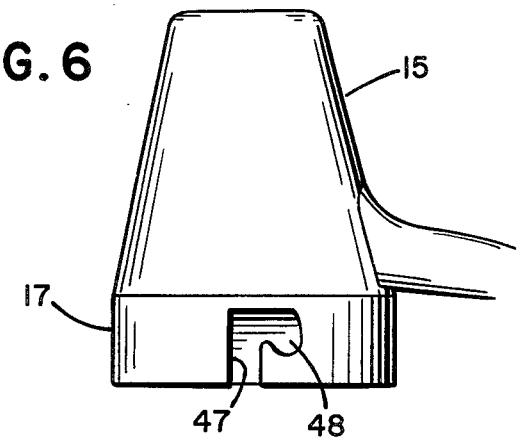
FIG. 6 is a sectional view illustrating the means for securing the adapter of FIG. 5 to the main valve body of the dispensing apparatus of the invention.
Figure 5:
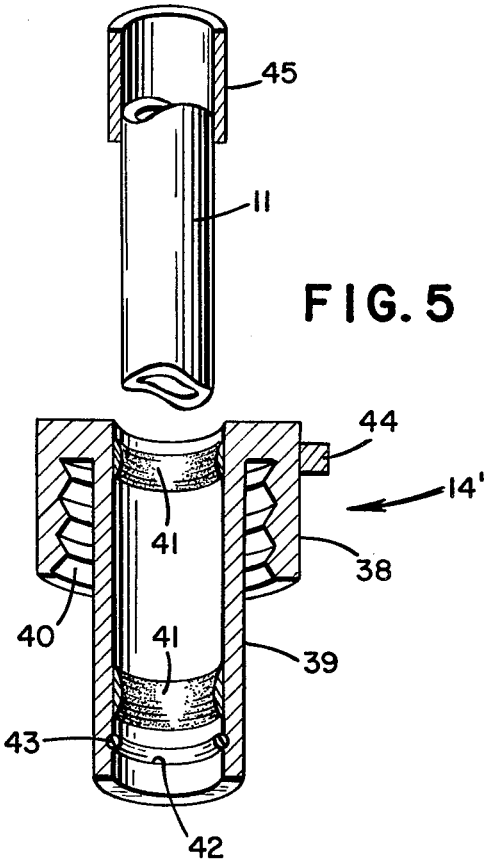
FIG. 5 is a partial sectional view, in elevation, of a particularly advantageous embodiment of the invention and involving the details of an adapter utilized for detachably securing the valve mechanism of the invention to a fluid container such as shown in FIG. 1.

While the adapter-siphon tube assembly, as shown in FIGS. 2 and 4, is simple in design and construction, a particularly advantageous and preferred adapter and siphon tube design is shown in FIGS. 5 and 6. In this embodiment, the adapter, indicated generally at 14' in FIG. 5, comprises an integral one-piece member having a conically shaped outer wall portion 38 and an inner cylindrical tubular portion 39. As shown in FIG. 5, the inner surface of the outer wall 38 includes internal threads 40 which are adapted to engage, and mate with, the external threads of the bottle or container 10. As also shown in FIG. 5, the adapter 14' further includes roughened portions 41 formed on the interior of the cylindrical tube 39 and an annular recess 42 adapted to receive an O-ring indicated at 43. A small locking knob 44 is also formed integral with, or secured to, the outer wall 38 of the adapter. In this regard, in the practice of this embodiment, the siphon tubing (11) itself is secured to the main valve body 15 of the valve mechanism by permanently affixing or securing the cylindrical stiffening member 45 to the lower ends or terminal portion 46 of the cylindrical walls forming the valve stem passageway 18. The upper end of the siphoning tube 11 is secured to the stiffening member 45, the latter merely serving as means to firmly attach the tube 11 to the valve body 15.

In the use of this embodiment, the adapter of FIG. 5 is simply slipped over the lower end of the tubing 11, which as aforesaid, is permanently secured to the main valve body, and is moved up the tube until the adapter is positioned within the annular flange portion 17 of the main valve body 15. In this regard, the adapter 14 should be positioned within the annular flange 17 in a manner such that the locking knob 44 passes through a mating slot 47 formed in the walls of the annular flange 17 as shown in FIG. 6. The adapter is then locked or secured to the main valve body 15 by simply turning the adapter so that the locking knob 44 is caused to pass within the substantially horizontal slot portion 48. In the practice of this embodiment, the unique valve mechanism of the invention may be readily adapted for use with bottles or containers having various thread designs and/or discharge openings. For example, in lieu of the threads 40, the internal surface of the wall portion 38 may be designed so as to conform with non-threaded discharge openings. Also this embodiment, although not complex in design, is structurally very strong and easy to manufacture. For example, the main valve body 15, as well as the stiffening tube 45 and siphoning tube 11, may be formed as an integral one-piece unit by known high-pressure injection molding techniques. The adapter, which may be of varying designs so as to conform with the particular bottle or container being used, is then simply slipped up the siphoning tube and the device is ready for use in the manner as set forth hereinabove. The siphon tube 11 is securely positioned within the adapter 14' by way of the roughened portions 41 and O-ring 43 formed on or positioned within, the interior surface of the cylindrical tube 39.

As noted above, in the practice of the invention, the diameter ($D_1$) of the siphon tube 11 must be greater than that diameter ($D_2$) of the nozzle or spout 30. In this connection, it has been further discovered that improved results are also obtained if the diameter of the valve stem 19 is reduced in that area wherein the valve stem passes through the lower enlarged portion 23 of the central cavity 18. Thus, with reference to FIGS. 2 and 3, in a particularly advantageous and preferred embodiment, the valve stem has a reduced diameter, indicated at 50, which extends substantially the full length of the aforesaid lower enlarged portion 23. In this manner, the restrictions to flow within the openings or passageways 23 and 29 (which communicates with the opening 31 of the spout 30) are greatly reduced and the back pressure is only created by way of the reduced size of the opening 31 of the discharge spout.

As should be readily appreciated by those skilled in the art, the present invention provides a fluid dispenser that is simple in construction and which may be easily and inexpensively manufactured. For example, the frusto conical shape of the main valve body renders it particularly suitable for manufacture by known high-pressure injection molding techniques. Further, instead of using carbon dioxide cylinders and/or piston actuated mechanisms, both of which involve considerable additional expense and difficulty in use, in accordance with the present invention, all the user has to do is to shake the container moderately and simply press down on the pressure cap with the fluid in the container or bottle then being self-dispersed in a manner involving an absolute minimum of time and difficulty. A further feature of the invention lies in the fact that the fluid in the container may be preserved for considerable periods of time and may be dispensed when desired in a fresh and uncontaminated manner.

Thus, the present invention not only provides a means for preserving a carbonated beverage, but also provides a dispensing apparatus for serving beverages in a simple, attractive, efficient and highly sanitary manner. While various embodiments have been illustrated hereinabove, it should be expressly understood that such embodiments have been disclosed for illustrative purposes only and that various modifications may be made without departing from the scope or spirit of the present invention. For example, the openings or cavities 51 formed in the main valve body are provided to strengthen the outer walls 16. Such design may be modified.

What is claimed is:

1. An apparatus for dispensing fluids comprising, in combination, a fluid container having a discharge opening and a dispensing valve mechanism detachably coupled with said discharge opening of said container; said dispensing valve mechanism comprising a main valve body having an upper wall portion and a lower integral annular flange portion; adapter means for detachably coupling said valve mechanism to said fluid container; said adapter means positioned within said lower annular flange portion of said main valve body; said dispensing valve mechanism further comprising a valve stem movably mounted within a central cavity formed in said main valve body; a fluid discharging spout secured to said main valve body and in operable communication with said cavity formed in said main valve body; an elongated tube projecting into said fluid container and being in sealing engagement with said adapter means; the ratio of the internal diameter of said elongated tube and said discharge spout being at least about 1.2 to 1; means for maintaining said valve stem in a normally closed position; means secured to said valve stem which, upon the application of a force thereto, causes said valve stem to move into an open position whereby the fluid in said container is caused to be forced through said fluid discharging spout by the vapor pressure of said fluid itself.

2. An apparatus for dispensing carbonated fluids from a container comprising a main valve body; adapter means secured to said main valve body for detachably coupling said valve to a fluid container; a valve stem movably mounted within a central cavity formed in said main valve body, said valve stem having first and second ends; resilient means positioned with said central cavity for maintaining said valve stem in a normally closed position; an elongated tube in sealed engagement with said adapter means and adapted to be projected into said fluid container; a fluid discharge spout secured to said main valve body and in operable communication with said central cavity; the ratio of the internal diameter of said elongated tube and said discharge spout being in the range of about 1.2:1 to 2.0:1; and means secured to said first end of said valve stem which, upon the application of a force thereto, causes said valve stem to be moved into an open position whereby the fluid in said container is caused to be forced into said elongated tube and to be dispenses from said discharge spout.

3. The apparatus of claim 1 wherein said ratio is in the range of from between about 1.2:1 to 2.0:1.

4. The apparatus in accordance with claim 2 wherein said main valve body comprises an upper conically shaped wall portion and a lower annular flange portion and wherein said resilient means comprise a spring and wherein said adapter means is positioned within said lower annular flange portion of said main valve body.

5. The apparatus in accordance with claim 4 wherein said elongated tube is permanently secured to said main valve body.

6. The apparatus in accordance with claim 5 wherein said adapter means further comprises means for interlocking said adapter means with said lower annular flange portion of said main valve body.

7. The apparatus in accordance with claim 6 wherein said upper wall portion of said main valve body is frustoconical in shape and wherein said valve stem has a reduced diameter which extends at least along the lower portion thereof.

8. The apparatus in accordance with claim 7 wherein said main valve body is formed of a plastic material and wherein a cavity is formed, and defined by, the outer walls of said main valve body and the walls forming said central cavity.

* * * * *